US007052201B2

(12) United States Patent
Zivkovic

(10) Patent No.: US 7,052,201 B2
(45) Date of Patent: May 30, 2006

(54) SAFETY BOLLARD

(75) Inventor: Gradimir Zivkovic, Hallett Cove (AU)

(73) Assignee: Automotive Safety Engineering Pty Ltd (AU)

( * ) Notice: Subject to any disclaimer, the term of this patent is extended or adjusted under 35 U.S.C. 154(b) by 0 days.

(21) Appl. No.: 10/477,010

(22) PCT Filed: May 8, 2001

(86) PCT No.: PCT/AU01/00521

§ 371 (c)(1),
(2), (4) Date: Aug. 9, 2004

(87) PCT Pub. No.: WO02/090663

PCT Pub. Date: Nov. 14, 2002

(65) Prior Publication Data

US 2004/0265055 A1 Dec. 30, 2004

(51) Int. Cl.
*W01F 9/11* (2006.01)

(52) U.S. Cl. ..... 404/11; 404/9; 404/10

(58) Field of Classification Search ..... 404/6, 404/9–11; 116/63 R; 256/13.1
See application file for complete search history.

(56) References Cited

U.S. PATENT DOCUMENTS

| | | | | |
|---|---|---|---|---|
| 3,371,647 | A * | 3/1968 | Shopbell | 116/209 |
| 3,787,033 | A * | 1/1974 | Snyder et al. | 256/59 |
| 4,015,827 | A * | 4/1977 | Brand | 256/59 |
| 4,148,455 | A * | 4/1979 | Oliver | 248/524 |
| 4,358,090 | A * | 11/1982 | Glaesener | 256/13.1 |
| 4,862,823 | A * | 9/1989 | Hughes | 116/209 |
| 5,160,111 | A * | 11/1992 | Hugron | 248/548 |
| 5,207,175 | A * | 5/1993 | Andonian | 116/209 |
| 5,208,585 | A * | 5/1993 | Sprague | 340/908.1 |
| 5,636,944 | A * | 6/1997 | Buttimore | 405/244 |
| 6,435,760 | B1 * | 8/2002 | Pettesch | 404/6 |

FOREIGN PATENT DOCUMENTS

| | | | |
|---|---|---|---|
| AU | 752762 | A | 3/1999 |
| EP | 571082 | A1 | 11/1993 |
| EP | 735194 | A2 | 10/1996 |
| FR | 2641557 | A | 7/1990 |
| FR | 2658216 | A | 8/1991 |
| SU | 1768695 | A1 | 10/1992 |
| WO | WO 93/20312 | A1 | 10/1993 |
| WO | WO 00/08259 | A1 | 2/2000 |

* cited by examiner

*Primary Examiner*—Raymond W. Addie
(74) *Attorney, Agent, or Firm*—Craig A. Fieschko, Esq.; DeWitt Ross & Stevens S.C.

(57) ABSTRACT

A safety bollard, post or stanchion to protect adjacent a vehicular area, each bollard, post or stanchion being so designed to provide a progressively increasing resistance to bending and/or deformation on impact by a vehicle, whereby the force of impact is progressively absorbed by the bollard, post or stanchion and deformation of the vehicle whereby the vehicle is progressively decelerated.

20 Claims, 5 Drawing Sheets

SAFETY BOLLARD

FIELD OF THE INVENTION

This invention relates to a safety bollard, post or stanchion.

BACKGROUND OF THE INVENTION

In many areas fences or posts or bollards are erected to delimit the area beyond which motor vehicles can pass, and if struck by a vehicle these often break and do not effectively prevent or slow down the passage of the vehicle into the area beyond the fence or posts. Also posts or bollards have been erected to prevent vehicles being used to smash into the windows of retail premises in what is known as a "ram raid". These have been substantially solid metal posts embedded in a concrete base. While these have been effective to a degree, it has been found that if struck by a vehicle that the post or bollard will bend to an inclined angle. The vehicle on passing over the inclined post will be thrown upward in an uncontrolled manner.

With the advent of outdoor dining becoming more popular, due in some respect to the ban on smoking in confined areas, more diners are being positioned on footpaths and side walks very close to passing traffic. In these situations it is realised that unless there can be provided adequate safety measures, serious accidents can occur.

Various posts have been proposed as crash barriers for vehicles, these being firmly embedded and fixed in the ground, such as by being fixed in a concrete block. Examples of such posts are shown in PCT/AU93/00124, AU80848/98 and AU20146/92. These posts are all designed to bend or deform at or about ground level and thus do not overcome the problem outlined above. The energy to be absorbed by the post is provided by the resistance to the bending of the post.

SUMMARY OF THE INVENTION

It is an object of the invention to provide a safety post or bollard to absorb some or all of the energy on impact of a motor vehicle.

It is a further object of the invention to provide a safety post and mounting to slow down or stop a vehicle prior to the post being bent or deformed.

A further object of the invention is to provide a mounting for a safety post, the mounting having means to absorb the energy on an impact on the post.

It is a still further object of the invention to provide a bollard, post or stanchion which has the desired degree of resistance to bending or crumpling to prevent or minimise the degree of entry of a vehicle into an area.

There is provided according to the invention a safety bollard, post or stanchion which is designed to prevent or minimise entry of a vehicle into an area, said safety bollard, post or stanchion being so designed to progressively absorb portion of the impact forces, the remainder of the impact forces being absorbed by deformation of the vehicle whereby the vehicle is progressively decelerated.

Thus there is also provided according to the invention a safety post wherein the post is mounted in a manner such that the energy is absorbed in the mounting before damage or bending of the post occurs.

Also there is provided according to the invention a safety post supported in a mounting such that the post can tilt against an increasing resistance on impact by a vehicle.

Preferably the post below the surface or pavement level is embedded in a bed of granular material such as sand.

Preferably the mounting of the post includes a concrete base embedded in the ground, the base having a hollow conical interior, sand in the hollow interior in which the lower portion of the post is embedded, and an annular buffer ring surrounding the post at the upper portion of the base between the post and the base whereby on impact the post will tilt against the resistance of the sand the annular buffer ring.

Preferably the buffer ring provides an increasing resistance as the portion of the ring is compressed.

Thus there is provided according to a further form of the invention a bollard, post or stanchion in which the bollard, post or stanchion is constructed with portions having varying degrees of resistance to bending and/or deformation so that a proportion of the energy of the impacting vehicle is absorbed by the bollard, post or stanchion and a portion of the energy is absorbed by deformation of the vehicle.

It is preferred that the portion of the bollard, post or stanchion between its support in a base and just below the projected impact height is of greater strength against bending on impact than the portion of the post above the projected impact point.

It is preferred that the portion of greater strength also extends below ground or surface level.

It is preferred that the portion of lesser strength extends into the portion of greater strength to increase the strength thereof.

Also there is provided in accordance with a further form of the invention a safety bollard, post or stanchion means supporting the post in the ground, said means providing a progressive increasing resistance to tilting of the bollard, post or stanchion on impact of a vehicle, said bollard, post or stanchion further being constructed to have portions having varying degrees of resistance to bending and or deformation so that portion of the energy of the impacting vehicle is absorbed by the bollard, post or stanchion.

BRIEF DESCRIPTION OF THE DRAWINGS

In order to more fully describe the invention reference will now be made to the accompanying drawings in which.

DETAILED DESCRIPTION OF PREFERRED VERSIONS OF THE INVENTION

Figure 1:
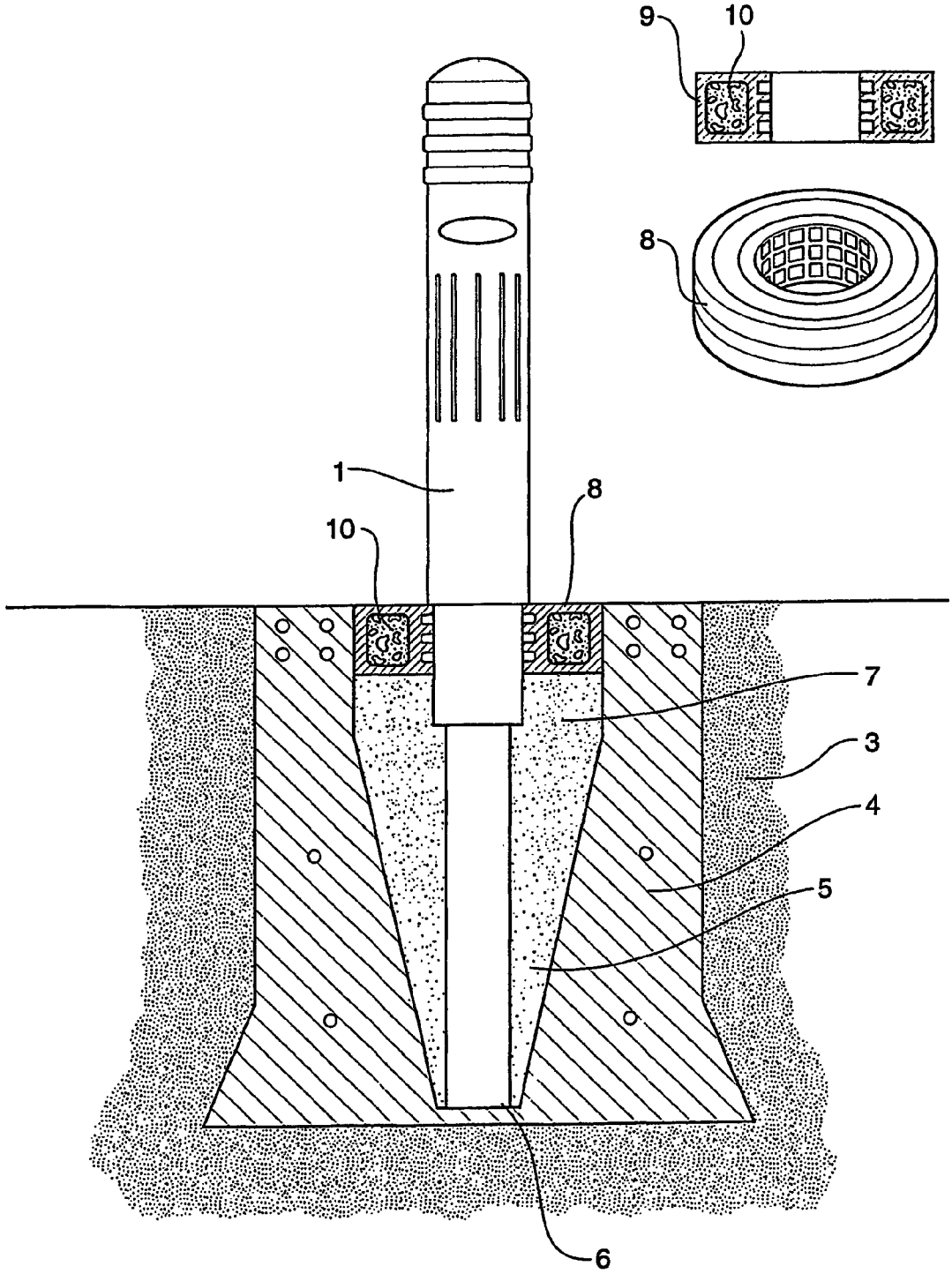
FIG. 1 is a cross sectional view of one form of the invention.
Figure 2:
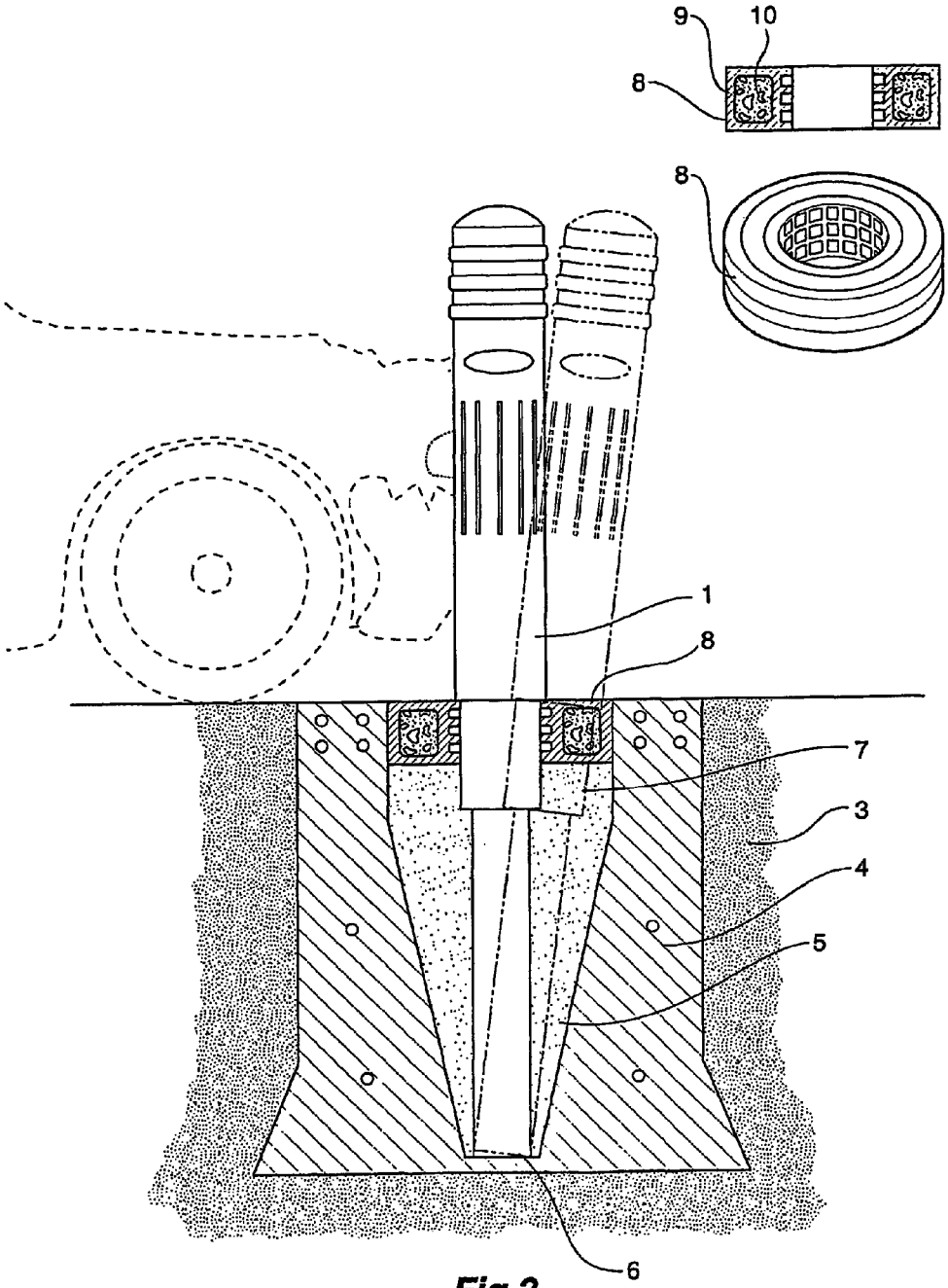
FIG. 2 is a similar view showing the post on impact.
Figure 3:
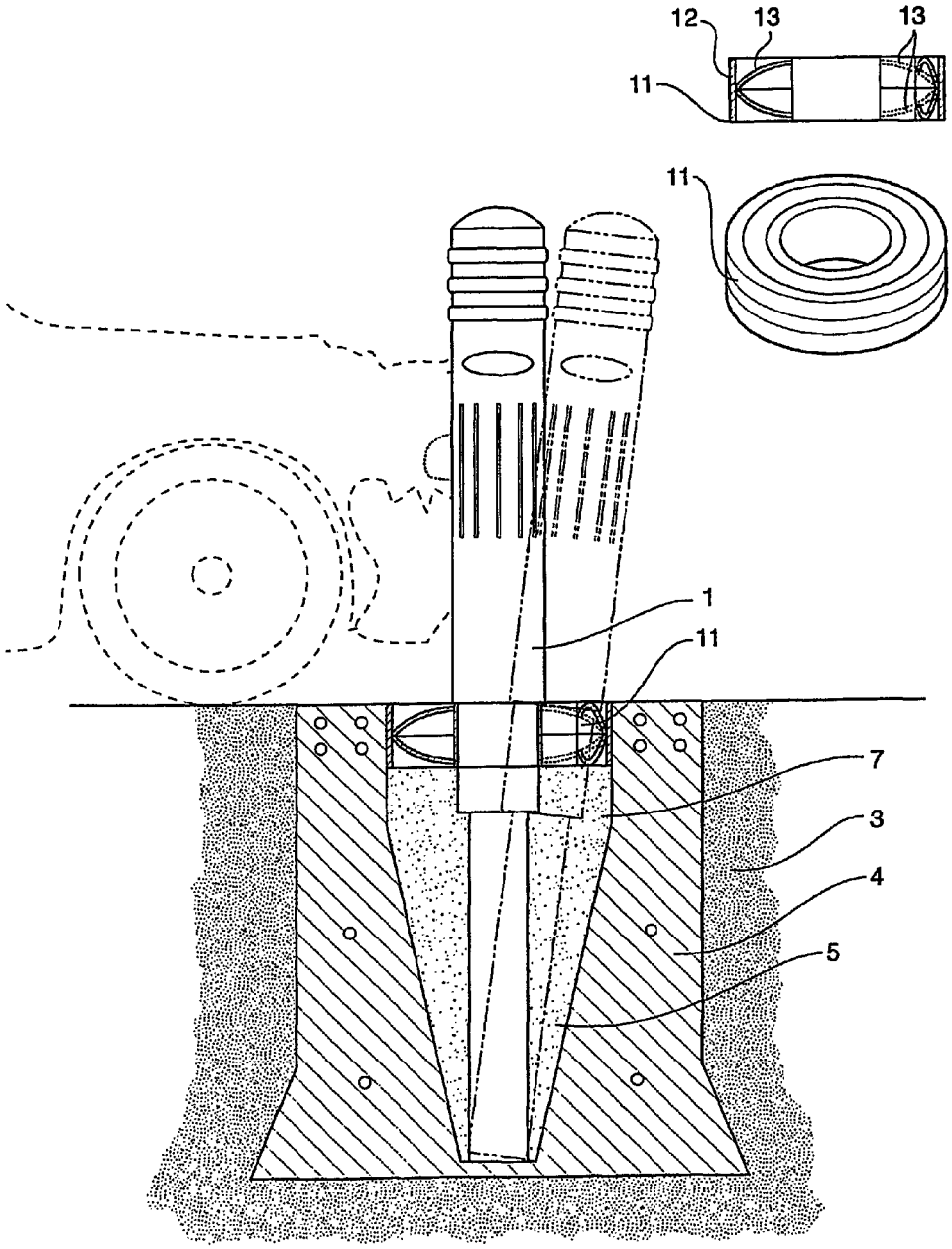
FIG. 3 is a view of a further form of the invention.

Referring to FIGS. 1 to 3 of the drawings. The post 1 is embedded in a bed is fluid material such as granular material eg, sand 2. Embedded or cast into the soil 3 is a concrete base or foundation 4. The base is preferably circular and has a hollow interior 5 which has a narrow bottom 6 and tapers to a wider mouth 7, the post 1 extending to adjacent or the bottom of the interior 6.

The post or bollard 4 is constructed preferably of metal that does not shatter during impact or may be of cylindrical tubes which are positioned, attached or telescoped one on the other. At the mouth 7 of the base there is positioned a buffer collar 8 to preferably snugly embrace the post 1 and is in contact with the inside surface of the mouth 7 of the base 4. In the example as shown in FIG. 1 the buffer 8 is an annular collar of hard resilient material 9 such as a plastics material and is filled with a structural foam 10.

As illustrated in FIG. 2, on impact of a vehicle on the post, the post will deflect and virtually pivot about its lower end against the resistance of the material around the post and against the resistance provided by the buffer 8.

The buffer 8 thus provides additional resistance to the movement of the post as a result of the impact, the buffer 8 collapsing at the area opposite to the impact.

FIG. 3 illustrates a further form of the invention wherein the buffer 11 includes a metal annular ring or rim 12 containing a plurality of circumferentially spaced discs 13 of VEE shaped formation, the discs being in contact with the post. As shown in FIG. 3 the undeformed discs are shown on the left side of the buffer 11 and the deformed discs shown on the right side of the buffer 11.

Thus it can be seen that by the invention the post will tilt and in so doing absorb the energy of the impact of the vehicle, preventing the vehicle from entering the area protected by the posts. Of course it will be appreciated that if a vehicle is travelling well in excess of the speed limit for that area, that the post may not be sufficient to prevent the vehicle from breaking the post and entering the area desired to be protected. No suitable protection can be provided to protect the area in the event of a large heavy vehicle travelling at excess speed, and the invention is intended to protect the area in the event of normal traffic conditions slightly in excess of the local speed limit.

It will be seen that the post is deflected and tilted without any detrimental damage to the post, the degree of tilt being such that the vehicle cannot ride up over the post and enter the area behind the post.

In the event that the post has been struck by a vehicle and the buffer ring has been collapsed in portion opposite to the point of impact it is merely necessary to replace the buffer ring. The post may be moved back to the vertical position and the sand repositioned around the post, or the post may be removed, the sand removed and the post repositioned or replaced with a new post and the sand replaced with tamping of the sand if required.

Thus it can be seen that it is a simple matter to replace the post. This is to be compared with the prior art to replace a damaged post, in which case the concrete holding the post has to be removed, for example by jack hammers, a new post repositioned and concreted in position.

It will be appreciated that the buffer collar can be of any desired material and construction and while two variations have been described, it will be appreciated that other forms of collars can be used which will absorb the impact energy during compression of the collar.

Referring to FIGS. 4 to 10 of the drawings the post generally indicated at 15 has a member 11 extending the length of the post, the member 11 having two sides parallel to each other and forming what may be called the front and the back of the post, the sides 1 being joined by a cross member 1(*a*). Thus the member 1 may be termed in cross section an I or H beam. The post is designed to be impacted by the front or what may be termed the bumper of the vehicle at the area indicated in FIG. 1(*b*).

Below this anticipated impact area there are plates 12 positioned between the sides 11 from each side of the post. Each plate 12 is of angular form with the apex of each plate meeting the corresponding apex at the centre line of the post. This plate has been positioned for angular impact of a vehicle.

Figure 10:
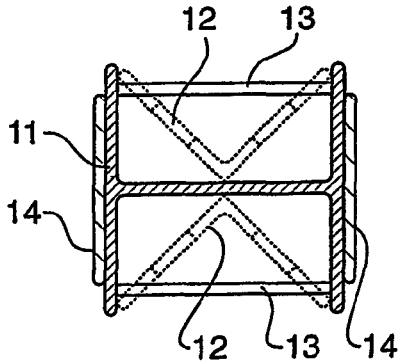
FIG. 10 is a cross-sectional view along the lines B—B of FIG. 5.

In a lower portion of the post there are added plates 13 on opposite sides of the post to close the angular portion of the plates 12, as indicated in FIG. 10. This Figure also shows the addition of plates 14 positioned on top of the side plates 11 to thus provide at this portion of the post a substantial strength and resistance to bending on the post on impact.

The desired bending and deformation of the post is provided by holes in the post. Thus the members 12 have holes 21(*a*) formed therein, and the plate 13 has holes 13(*a*) formed therein.

Figure 4A:
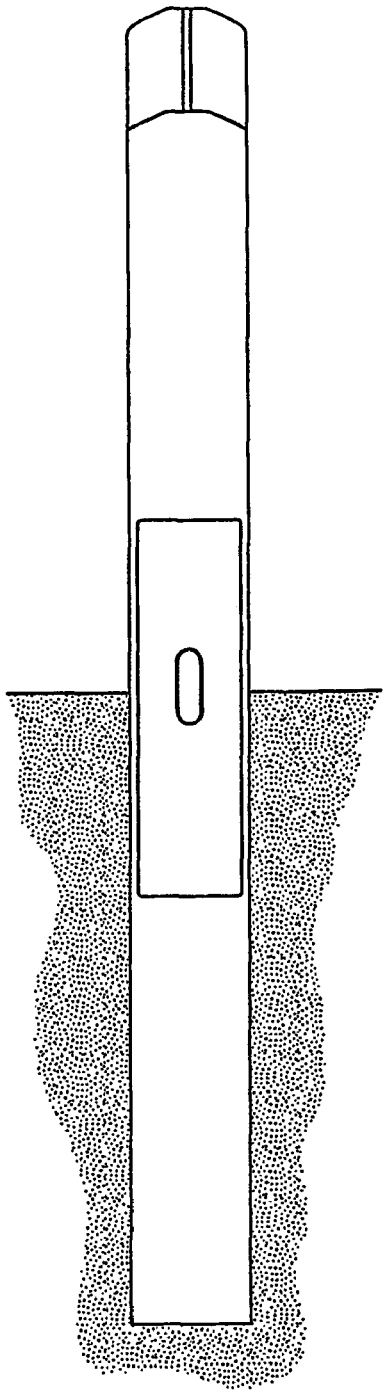
FIGS. 4(*a*) and 4(*b*) are side views of a post, bollard or stanchion before and after impact of a vehicle.
Figure 4B:
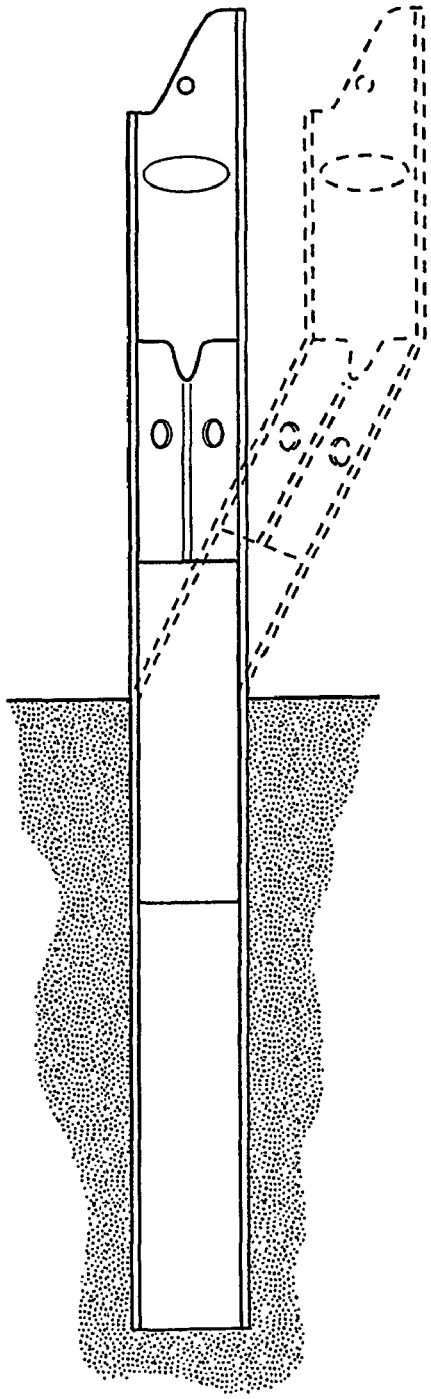
Figure 5:
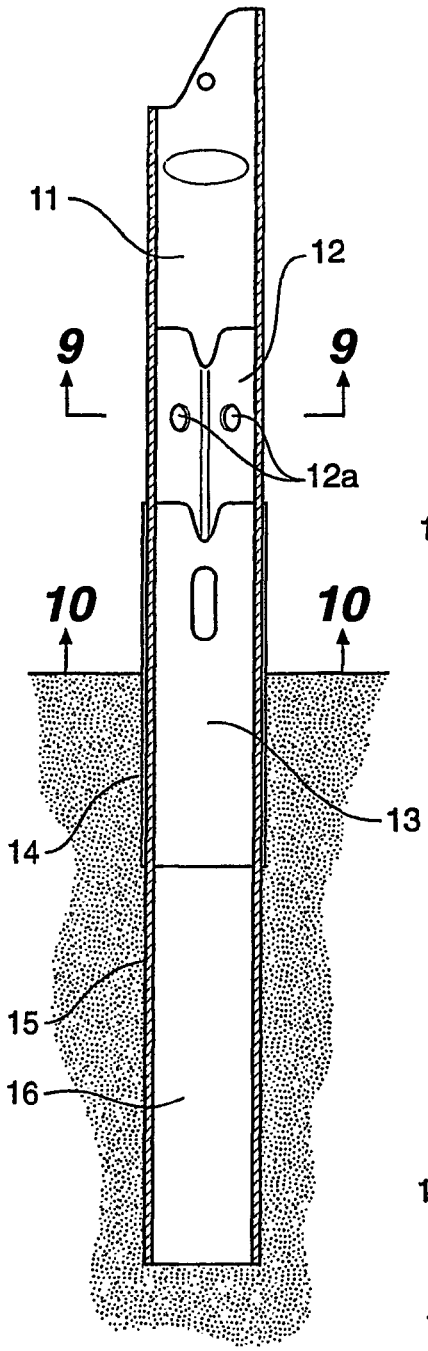
FIG. 5 is a cross-sectional side view according to the invention.
Figure 6:
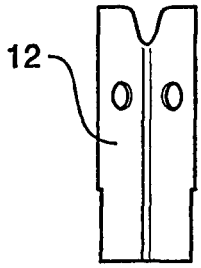
FIGS. 6, 7 and 8 are views of the plates used in the post.
Figure 7:
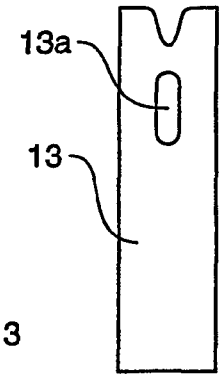
Figure 8:
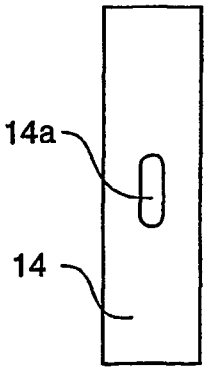
Figure 9:
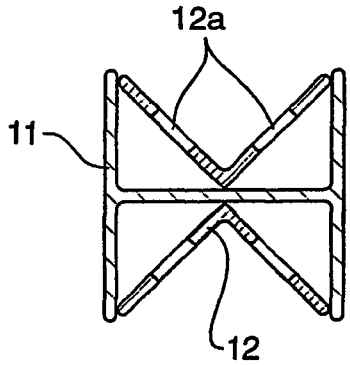
FIG. 9 is a cross-sectional view along the lines A—A of FIG. 5.

As shown in FIG. 4(*b*) the post is designed to progressively bend and deform at the shown locations.

Thus it will be seen that by the combination of different profiles of plates and shapes and position of the holes, a bollard or post is provided which will progressively crumple to thus provide a progressively increasing resistance to an impacting vehicle. The vehicle will also be progressively crumpling at this time so that the energy of the vehicle is progressively absorbed thus reducing injuries on the occupants of the vehicle. In this way the vehicle is progressively slowed thus minimising the entry of the vehicle past the bollard, protecting any people behind the bollard.

Thus it can be seen by the invention that the safety bollard, post or stanchion may be used in different ways. There may be the mounting as described in the first embodiment whereby on impact by a vehicle the bollard post or stanchion tilts under a progressively increasing resistance, the force of the impact being absorbed both by the bollard, post or stanchion and the vehicle. Alternately the bollard, post or stanchion may be constructed with portions having varying degrees of resistance to bending or deformation so that the force of the impact is absorbed by both the bollard, post or stanchion and the vehicle.

In a further alternative the bollard, post or stanchion of the second embodiment maybe mounted to tilt in its mounting as in the first embodiment so that there is the dual effect of absorbing the impact of the vehicle, together with the ease of replacement of the bollard, post or stanchion.

Also the post or bollard itself can be of various forms of construction either of hollow metal construction with or without an energy absorbing filler.

In this way it can be seen that according to the invention the safety bollard or stanchion provides a progressive deceleration of the vehicle, part of the impact forces being absorbed by the safety bollard, post or stanchion and the remainder by deformation of the vehicle. Thus the vehicle does not instantly stop to a dead stop, or the safety bollard, post or stanchion does not beak off and permit the continued movement of the vehicle.

Although various forms of the invention have been described in some detail it is to be realised that the invention is not to be limited thereto but can include variations and modifications falling within the spirit and scope of the invention.

The invention claimed is:

1. A safety bollard for resisting entry of a vehicle into an area, the bollard embedded in granular material in a base, the base being embedded in the ground, and an annular buffer collar surrounding the bollard at the upper portion of the base above the granular material, with the buffer collar fit between the bollard and the base, wherein on impact the bollard it tiltable with respect to the base, with the buffer collar being deformable and the granular material being displaceable to provide a progressive increase in resistance to the tilting of the bollard.

2. The bollard of claim 1 wherein:

the interior of the base is conical.

3. The bollard of claim 1 wherein the buffer collar is an annular ring of hard plastic material tiled with structural foam.

4. The bollard of claim 1 wherein the buffer collar is an annular ring of discs, the discs being fit about the bollard at different heights, and wherein the heights of the discs vary with their radii such that the discs are more closely spaced at one of their inner or outer diameters and more distantly spaced at the other of their inner and outer diameters.

5. The bollard of claim 1, wherein the granular material is sand.

6. The bollard of claim 1, wherein the collar is at least partially formed of foam.

7. The bollard of claim 1, wherein the collar includes a series of discs disposed along the height of the bollard.

8. A safety bollard comprising:

a. an elongated stanchion having a bottom section and a top section;

b. a rigid base having a top surface with an interior pocket descending therefrom, wit the stanchion having its bottom section situated within the pocket so that the top section of the stanchion protrudes upwardly from the pocket in the base;

c. a collar fit about the stanchion within the pocket, with the collar being situated between the stanchion and the base to space the stanchion from the base, with the collar having an outer diameter approximating the inner diameter of the pocket, the collar being deformable when the stanchion is subjected to vehicle impact.

9. The safety bollard of claim 8 wherein the pocket is filled with fluid material below the collar.

10. The safety bollard of claim 9 wherein the fluid material is granular.

11. The safety bollard of claim 10 wherein the granular fluid material is sand.

12. The safety bollard of claim 8 wherein the pocket narrows as it descends into the base.

13. The safety bollard of claim 8 wherein the collar is at least partially formed of porous solid material.

14. The safety bollard of claim 13 wherein the porous solid material is foam.

15. The safety bollard of claim 13 wherein the porous solid material is at least partially surrounded by a rigid shell.

16. The safety bollard of claim 8 wherein the collar includes stacked rings wherein adjacent rings have spacing which varies along their radii.

17. The safety bollard of claim 8 wherein the top section of the stanchion is hollow along at least a portion of its length, and wherein the hollow portion of the top section has changing resistance to deformation along its height.

18. The safety bollard of claim 17 wherein the changing resistance to deformation is provided by one or more of:

a. providing inserts within she stanchion;

b. defining apertures in the stanchion; and c. defining apertures in the inserts.

19. The safety bollard of claim 18 wherein the inserts are chosen from one or more of plates, angle members, and beams.

20. The safety bollard of claim 8 wherein the collar provides progressively increasing resistance to deformation once deformation begins.

* * * * *